US007749106B2

(12) United States Patent
Shindo et al.

(10) Patent No.: US 7,749,106 B2
(45) Date of Patent: Jul. 6, 2010

(54) MOLDED RUBBER MATERIAL FOR GOLF BALL, METHOD OF MAKING THE MATERIAL AND GOLF BALL

(75) Inventors: Jun Shindo, Chichibu (JP); Atsushi Nanba, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 594 days.

(21) Appl. No.: 11/392,596

(22) Filed: Mar. 30, 2006

(65) Prior Publication Data

US 2007/0232415 A1 Oct. 4, 2007

(51) Int. Cl.
*A63B 37/00* (2006.01)

(52) U.S. Cl. ..... 473/351

(58) Field of Classification Search ..... 473/351
See application file for complete search history.

(56) References Cited

U.S. PATENT DOCUMENTS

2002/0058737 A1* 5/2002 Nishiwaki et al. ..... 524/431
2004/0110906 A1* 6/2004 Fujisawa et al. ..... 525/331.9

FOREIGN PATENT DOCUMENTS

| | | | |
|---|---|---|---|
| JP | 2000-191489 A | | 7/2000 |
| JP | 2003-126300 | * | 5/2003 |
| JP | 2003-126300 A | | 5/2003 |

* cited by examiner

*Primary Examiner*—Raeann Trimiew
(74) *Attorney, Agent, or Firm*—Sughrue Mion, PLLC

(57) ABSTRACT

A molded rubber material for a golf ball is obtained by molding and vulcanizing a rubber composition composed of (a) a diene rubber, (b) an α,β-unsaturated carboxylic acid and/or a metal salt thereof, (c) an organic peroxide, and (d) an inorganic oxide. The inorganic oxide is prepared by a plasma process, a laser process or flame synthesis, has an average particle size of at most 200 nm, and is added in an amount of at least 1 wt % based on the zinc acrylate. The molded rubber material has a high hardness, a good resilience, and excellent durability.

13 Claims, 2 Drawing Sheets

MOLDED RUBBER MATERIAL FOR GOLF BALL, METHOD OF MAKING THE MATERIAL AND GOLF BALL

BACKGROUND OF THE INVENTION

The present invention relates to a spherical rubber molding suitable for use as a one-piece golf ball material or as a core material for solid golf balls such as two-piece golf balls and three-piece golf balls. More specifically, the invention relates to a molded rubber material for golf balls which has a high hardness, a high resilience and a high durability. The invention additionally relates to a method of producing such a molded rubber material, and to a golf ball in which such a molded rubber material is used.

Rubber compositions for producing molded and crosslinked rubber materials are generally made of polybutadiene, zinc acrylate and an organic peroxide, and include also zinc oxide as a filler or as a vulcanizing agent or vulcanization co-accelerator. If zinc oxide is not included in the rubber composition, the molded material obtained from the composition will soften, resulting in a lower durability. Therefore, zinc oxide is often included in molded and crosslinked rubber materials for use as solid cores and the like in the production of golf balls. In particular, zinc oxide is known to function as an activator which exerts a large influence on crosslinking reactions between rubber molecules. Hence, it is likely that the quality and compounding ratio of this zinc oxide strongly affect the physical qualities of the molded and crosslinked rubber material. The degree of activity by zinc oxide varies with its particle size. For example, when fine particles of zinc oxide are used, the zinc oxide has a higher degree of activity, making it possible to readily achieve a high hardness and also improving the durability.

This is illustrated by JP 2003-126300, which discloses improved resilience and durability owing to the use of zinc oxide having an average particle size of 200 nm or less in a rubber composition for golf balls.

However, the zinc oxide is difficult to uniformly disperse in such a composition. By enhancing uniform dispersion, there is room for further improvement in reactivity and durability.

A variety of methods are known for producing fine zinc oxide particles, including dry methods, wet methods and grinding methods. For example, along dry methods based on the French process, one chemical vapor phase deposition process categorized as the electric furnace process involves melting and vaporizing metallic zinc at a low temperature of 1500° C. or below so as to oxidize it with air, then cooling to obtain zinc oxide. Among wet methods, zinc oxide can be obtained by reacting a solution of a soluble zinc salt with an alkali solution. Grinding methods include the reduction of zinc oxide having a large particle size to fine particles by physical grinding such as in a jet mill.

Moreover, JP-A 2000-191489 teaches a process for enhancing dispersibility by applying a surface treatment agent to zinc oxide which is in the form of fine particles.

However, the surface treatment in this process has the undesirable effect of lowering the degree of activity by the zinc oxide, preventing the physical improvements arising from the high activity of the fine particles from being achieved.

SUMMARY OF THE INVENTION

It is therefore an object of the present invention to provide a molded rubber material for golf balls which has a high hardness and an excellent durability. Another object of the invention is to provide a method of producing such a molded rubber material. Yet another object is to provide a golf ball in which such a molded rubber material is used.

On conducting extensive investigations to achieve these objects, we have discovered that, of the inorganic oxides such as zinc oxide which have been included in the various rubber compositions disclosed in the art to date, by using an inorganic oxide which is produced by a plasma process, a laser process or flame synthesis and which has an average particle size of 200 nm or less, and by optimizing the amount of this inorganic oxide included within the composition, the rubber moldings obtained from the composition achieve a high hardness owing to the fine particles of inorganic oxide such as zinc oxide which have a very uniform dispersibility while maintaining a high activity, thus making it possible to obtain molded materials endowed with both a high resilience and a high durability.

Accordingly, the invention provides the following molded rubber material for golf balls, the following method for making such a molded rubber material, and the following golf ball in which such a molded rubber material is used.

[1] A molded rubber material for a golf ball which is obtained by molding and vulcanizing a rubber composition composed of (a) a diene rubber, (b) an α,β-unsaturated carboxylic acid and/or a metal salt thereof, (c) an organic peroxide, and (d) an inorganic oxide; wherein the inorganic oxide is prepared by a plasma process, a laser process or flame synthesis, has an average particle size of at most 200 nm, and is added in an amount of at least 1 wt % based on the α,β-unsaturated carboxylic acid and/or metal salt thereof.

[2] The molded rubber material for a golf ball of [1], wherein the inorganic oxide is prepared by a plasma process, which plasma process is selected from the group consisting of arc plasma processes, plasma jet processes, and high-frequency induction heating plasma processes.

[3] The molded rubber material for a golf ball of [2], wherein the plasma process is an arc plasma process.

[4] The molded rubber material for a golf ball of [1], wherein the inorganic oxide is zinc oxide.

[5] The molded rubber material for a golf ball of [1], wherein the rubber composition additionally includes an organosulfur compound.

[6] The molded rubber material for a golf ball of [1], wherein the rubber composition additionally includes an inorganic oxide having an average particle size of at least 200 nm.

[7] A golf ball comprising a solid core and a cover of one or more layers which encloses the core, wherein the above-described molded rubber material is used as the solid core.

[8] A method of manufacturing a molded rubber material for a golf ball, the method being comprised of molding and vulcanizing a rubber composition composed of (a) a diene rubber, (b) an α,β-unsaturated carboxylic acid and/or a metal salt thereof, (c) an organic peroxide, and (d) an inorganic oxide; wherein the inorganic oxide is prepared by a plasma process, a laser process or flame synthesis, has an average particle size of at most 200 nm, and is added in an amount of at least 1 wt % based on the α,β-unsaturated carboxylic acid and/or metal salt thereof.

BRIEF DESCRIPTION OF THE DIAGRAMS

DETAILED DESCRIPTION OF THE INVENTION

Figure 1:
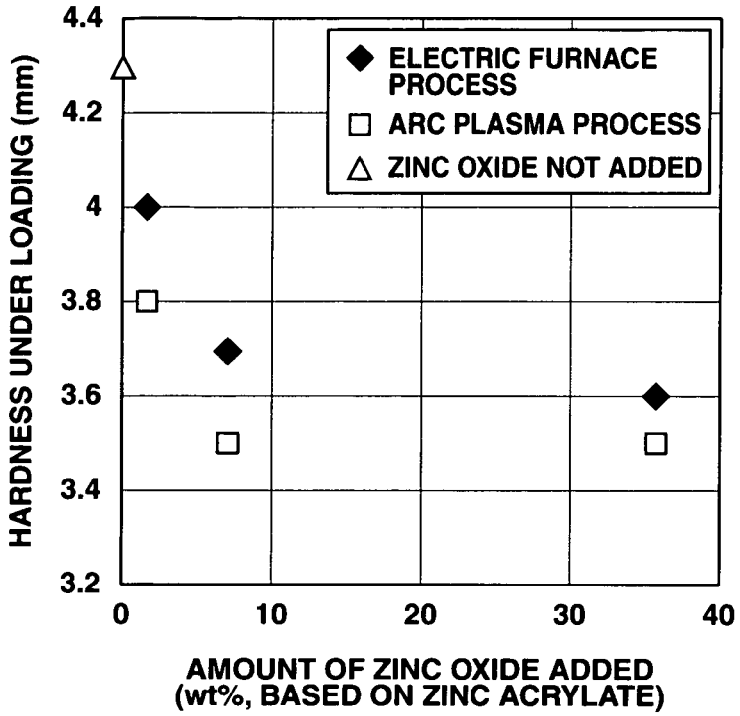
FIG. 1 is a graph showing the relationship between the amount of zinc oxide added and the hardness of the molded materials under loading.

The invention is described more fully below.

The rubber composition from which the molded rubber material for golf balls of the invention is produced contains the following components (a) to (d) as essential ingredients.

Component (a) is a diene rubber which serves as the base of the rubber composition. Although not subject to any particular limitation, preferred use may be made of a diene rubber composed primarily of polybutadiene.

In addition to polybutadiene, the diene rubber (a) may include also, for example, natural rubber, polyisoprene rubber and styrene-butadiene rubber.

As used herein, "composed primarily of polybutadiene" signifies that the polybutadiene accounts for at least 50 wt %, preferably at least 70 wt %, and most preferably 100 wt %, of the base rubber.

The polybutadiene has a cis-1,4 bond content of at least 60%, preferably at least 80%, more preferably at least 90%, and most preferably at least 95%, and has a 1,2-vinyl bond content of not more than 2%, preferably not more than 1.7%, more preferably not more than 1.5%, and most preferably not more than 1.3%. Outside of these ranges, the resilience of the molded rubber material decreases.

The polybutadiene may be synthesized using a metal catalyst such as a rare earth catalyst (e.g., a neodymium catalyst), a cobalt catalyst or a nickel catalyst.

Component (b) is an α,β-unsaturated carboxylic acid and/or a metal salt thereof which functions as a co-crosslinking agent. Specific examples include acrylic acid, methacrylic acid, ethacrylic acid, itaconic acid, maleic acid, fumaric acid and/or their zinc salts, magnesium salts and calcium salts. The use of zinc acrylate is especially preferred.

The amount of α,β-unsaturated carboxylic acid and/or a metal salt thereof included per 100 parts by weight of the base rubber is generally at least 10 parts by weight, preferably at least 15 parts by weight, and more preferably at least 20 parts by weight, but generally not more than 60 parts by weight, preferably not more than 50 parts by weight, more preferably not more than 45 parts by weight, and most preferably not more than 40 parts by weight. Too much component (b) may make the molded material too hard, giving the golf ball an unpleasant feel on impact. On the other hand, too little may result in a lower resilience.

Component (c) is an organic peroxide which functions as a crosslinking agent between the rubber molecules or as a co-crosslinking agent (initiator). Illustrative examples include dicumyl peroxide and 1,1-bis(t-butylperoxy)cyclohexane. For example, preferred use can be made of Percumyl D (produced by NOF Corporation), Perhexa 3M (NOF Corporation), Perhexa C-40 (NOF Corporation) and Luperco 231XL (Atochem Co.). These may be used singly or as a combination of two or more thereof.

The amount of organic peroxide included per 100 parts by weight of the diene rubber (a) is generally at least 0.1 part by weight, preferably at least 0.3 part by weight, more preferably at least 0.5 part by weight, and most preferably at least 0.7 part by weight, but generally not more than 5 parts by weight, preferably not more than 4 parts by weight, more preferably not more than 3 parts by weight, and most preferably not more than 2 parts by weight. Too much or too little organic peroxide may make it impossible to achieve a ball having a suitable feel on impact, durability and rebound.

Component (d) is an inorganic oxide which, as noted above, differs from commonly used inorganic oxides. An inorganic compound which is produced by a plasma process, a laser process or flame synthesis, and which has an average particle size of 200 nm or less is used in the present invention. That is, in chemical vapor phase deposition processes, inorganic oxide in the form of fine particles having excellent flow properties and dispersibility can be obtained by a high-temperature process which, in contrast with the heating temperature of 1500° C. or below employed in the electric furnace process used to date, relies on a heating temperature in a plasma process, laser process or flame synthesis process of several thousands of degrees Centigrade. The resulting inorganic oxide has an improved dispersibility, yet maintains a higher activity than inorganic oxide obtained by the electric furnace process. As a result, molded rubber materials having a high hardness, a high resilience, and a high durability can be obtained.

Illustrative, non-limiting, examples of the above inorganic compound include zinc oxide, magnesium oxide, calcium oxide, titanium oxide, aluminum oxide, silicon oxide, selenium oxide, yttrium oxide, tin oxide, selenium oxide, copper oxide, bismuth oxide, cobalt oxide, iron oxide, manganese oxide and holmium oxide. The use of zinc oxide is effective in the present invention, and thus preferred.

The plasma process may be selected from among arc plasma processes, plasma jet processes and high-frequency induction heating plasma processes. From the standpoint of dispersibility, it is especially preferable to employ an arc plasma process.

A specific example of the above inorganic oxide that may be preferably used is the very fine zinc oxide having an average primary particle size of 0.03 μm obtained by the arc plasma process which is available from C.I. Kasei, Co., Ltd. under the trade name NanoTek (ZnO).

The above-described inorganic oxide (d) is added in an amount of at least 1 wt %, preferably at least 5 wt %, and more preferably at least 10 wt %, based on the α,β-unsaturated carboxylic acid and/or metal salt thereof serving as component (b). Although there is no fixed upper limit in the amount of addition, it is preferable for the amount of addition to be 30 wt % or less, and especially 20 wt % or less. Outside of this range, the specific gravity of the molded material may become too large and the molding may fall outside of the appropriate weight range for a golf ball core.

If necessary, the rubber composition in the invention may include an antioxidant, commercial examples of which include Nocrac NS-6, Nocrac NS-30 (both available from Ouchi Shinko Chemical Industry Co., Ltd.), and Yoshinox 425 (available from Yoshitomi Pharmaceutical Industries, Ltd.). These may be used singly or as combinations of two or more thereof.

The amount of antioxidant included, per 100 parts by weight of the diene rubber serving as component (a), is at least 0 part by weight, preferably at least 0.05 part by weight, more preferably at least 0.1 part by weight, and most preferably at least 0.2 part by weight, but generally not more than 3 parts by weight, preferably not more than 2 parts by weight, more preferably not more than 1 part by weight, and most preferably not more than 0.5 part by weight. Too much or too little may make it impossible to obtain a suitable resilience and durability.

The rubber composition may include also an organosulfur compound so as to enhance the resilience of the molded and crosslinked rubber material and to improve the initial velocity of the ball. The organosulfur compound is not subject to any particular limitation, and is exemplified by thiophenols, thionaphthols, halogenated thiophenols, and metal salts thereof, as well as polysulfides having 2 to 4 sulfurs. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. Diphenyldisulfide and the zinc salt of pentachlorothiophenol are especially preferred.

It is recommended that such an organosulfur compound be included in an amount, per 100 parts by weight of the diene rubber serving as component (a), of generally at least 0.05 part by weight, and preferably at least 0.1 part by weight, but generally not more than 5 parts by weight, preferably not more than 4 parts by weight, more preferably not more than 3 parts by weight, and most preferably not more than 2.5 parts by weight. With too much organosulfur compound, the desirable effects of addition may reach an upper limit beyond which further improvement is not achievable. On the other hand, adequate effects may fail to be achieved with the addition of too little organosulfur compound.

A suitable amount of inert filler, such as barium sulfate, calcium carbonate or silica, may also be included in the rubber composition, insofar as the objects of the invention are attainable. The amount of inert filler is not subject to any particular limitation, although it is typically included in an amount, per 100 parts by weight of the diene rubber serving as component (a), of preferably at least 5 parts by weight, and more preferably at least 10 parts by weight, but preferably not more than 40 parts by weight, and more preferably not more than 30 parts by weight. Too much or too little inert filler may make it impossible to achieve a suitable weight and a good resilience.

In the practice of the invention, it is also possible to include as a filler an inorganic oxide which, unlike above component (d), has an average particle size of at least 200 nm.

In the practice of the invention, the above-described rubber composition is masticated using a suitable apparatus, such as a roll mill, kneader or Banbury mixer, then is molded under heat and pressure in a mold to form a molded and crosslinked material. This molded and crosslinked material may be used as a one-piece golf ball, or as the solid core in a solid golf ball composed of a solid core and a cover of one or more layers enclosing the core. Conventional molding conditions may be employed, including, for example, a vulcanization temperature of 100 to 200° C. and a vulcanization time of 10 to 40 minutes. When a solid golf ball having a multi-layer construction, such as a two-piece ball, is produced, a cover of one or more layer is formed over a solid core made of the above-described rubber composition. The cover material may be suitably selected from among thermoplastic resins and thermoplastic elastomers such as ionomer resins, polyester elastomers, polyamide elastomers, polyurethane resins, and nylon.

When the molded rubber material described above is used as a solid core, the diameter, specific gravity and deflection of the solid core may be suitably selected according to the intended type of golf ball. For example, in the case of a two-piece solid golf ball, the solid core has a diameter of preferably at least 38.2 mm, and more preferably at least 38.8 mm, but not more than 42.0 mm, and preferably not more than 41.5 mm. In the case of a three-piece solid golf ball, the solid core has a diameter of preferably at least 36.0 mm, and more preferably at least 37.7 mm, but preferably not more than 41.5 mm, and more preferably not more than 41.0 mm.

It is recommended that the above solid core have a specific gravity of generally at least 0.9, preferably at least 1.0, and more preferably at least 1.1, but not more than 1.4, preferably not more than 1.3, and more preferably not more than 1.2.

The above solid core, when subjected to a final load of 130 kgf from an initial load of 10 kgf, has a deflection which, while not subject to any particular limitation, is preferably at least 2.0 mm, and more preferably at least 2.5 mm, but preferably not more than 7.0 mm, and more preferably not more than 6.0 mm. If the deflection of the solid core is too small, on long shots in which the golf ball incurs a large deformation, the ball may incur too much spin and fail to travel as far as expected. On the other hand, if the deflection is too large, the ball may have insufficient rebound and may fail to travel as far as expected, in addition to which it may have a poor durability. The deflection and the hardness may be regarded as the same indicator in a golf ball, with a large deflection being associated with a low hardness and a small deflection being associated with a high hardness.

The golf ball of the invention is one in which the material molded under heat from the above-described rubber composition serves as a component of the ball. The form of the ball is not subject to any particular limitation. For example, the ball may be a one-piece solid golf ball obtained by direct use of the above-described hot-molded material, a two-piece solid golf ball wherein the hot-molded material serves as a solid core on the surface of which a cover has been formed, or a multi-piece solid golf ball composed of three or more pieces wherein the hot-molded material serves as a solid core over which two or more cover layers have been formed.

The inventive golf ball may be produced in accordance with the Rules of Golf for use in competitive play. That is, the ball may be manufactured to a diameter of not less than 42.67 mm and a weight of not more than 45.93 g. It is recommended that the upper limit in the diameter be preferably not more than 44.0 mm, more preferably not more than 43.5 mm, and most preferably not more than 43.0 mm, and that the lower limit in the weight be preferably at least 44.5 g, more preferably at least 45.0 g, even more preferably at least 45.1 g, and most preferably at least 45.2 g.

The rubber molded material for golf balls of the invention has a high hardness, a good resilience, and an excellent durability. By using such a rubber molding as a one-piece golf ball material or as the solid core material in a multilayer solid golf ball, it is possible to obtain highly advantageous golf balls which have a large initial velocity and thus an increased travel distance, which prevent to the extent possible cracking when repeatedly hit, and which can greatly enhance durability.

EXAMPLES

The following Examples and Comparative Examples are provided by way of illustration and not by way of limitation.

Examples 1 to 4 and Comparative Example 1 to 4

Rubber compositions formulated as shown in Table 1 were prepared, masticated in a kneader or on a roll mill, then hot-molded in a spherical mold under vulcanization conditions of 160° C. and 20 minutes to give spherical crosslinked rubber moldings having a diameter of 37.7 mm.

TABLE 1

| | Example | | | | Comparative Example | | | |
|---|---|---|---|---|---|---|---|---|
| | 1 | 2 | 3 | 4 | 1 | 2 | 3 | 4 |
| Polybutadiene | 100 | 100 | 100 | 100 | 100 | 100 | 100 | 100 |
| Zinc acrylate | 28 | 28 | 28 | 28 | 28 | 28 | 28 | 28 |
| Zinc oxide I (arc plasma process) | 0.5 | 2 | 10 | 2 | 0 | 0 | 0 | 0 |
| Zinc oxide II (electric furnace process) | 0 | 0 | 0 | 0 | 0 | 0.5 | 2 | 10 |
| Zinc oxide III | 0 | 0 | 0 | 2 | 0 | 0 | 0 | 0 |
| Antioxidant | 0.1 | 0.1 | 0.1 | 0.1 | 0.1 | 0.1 | 0.1 | 0.1 |
| Organosulfur compound | — | — | — | — | — | — | — | — |
| Organic peroxide (1) | 0.3 | 0.3 | 0.3 | 0.3 | 0.3 | 0.3 | 0.3 | 0.3 |
| Organic peroxide (2) | 0.3 | 0.3 | 0.3 | 0.3 | 0.3 | 0.3 | 0.3 | 0.3 |
| Amount of zinc oxide addition relative to zinc acrylate (wt %) | 1.8 | 7.1 | 35.7 | 7.1 | 0 | 1.8 | 7.1 | 35.7 |

Note:
Numbers in the table indicate parts by weight

Details on each of the ingredients in the table are given below.

Polyurethane: BR730, produced by JSR Corporation.

Zinc acrylate: ZN-DA 85S, produced by Nihon Jyoryu Kogyo Co., Ltd.

Zinc oxide I: An ultrafine zinc oxide, available from C.I. Kasei, Co., Ltd. under the trade name NanoTek ZnO, having an average primary particle size of 0.03 μm and obtained by an arc plasma process.

Zinc oxide II: An ultrafine zinc oxide, available from Sakai Chemical Industry Co., Ltd. under the trade name Finex-50, having an average primary particle size of 0.02 μm and obtained by the evaporation and oxidation of electrolytic zinc metal.

Zinc oxide III: Grade 3 zinc oxide available from Sakai Chemical Industry Co., Ltd, a general-purpose zinc oxide having an average particle size of 0.6 μm.

Antioxidant: 2,2-Methylenebis(4-methyl-6-butylphenol) produced by Ouchi Shinko Chemical Industry Co., Ltd. under the trade name Nocrac NS-6.

Organosulfur compound: Zinc salt of pentachlorothiophenol.

Organic peroxide (1): Dicumyl peroxide produced by NOF Corporation under the trade name Percumyl D.

Organic peroxide (2): Product having a 1,1-di(t-butylperoxy) cyclohexane purity of 40%. Produced by NOF Corporation under the trade name Perhexa C-40.

The hardness (deflection) of the spherical rubber moldings obtained were determined as described below. The durability was evaluated according to the criteria shown below. The results are given in Table 2.

Hardness Under Loading (Deflection)

The deformation of the rubber molding when subjected to loading from an initial load of 98 N (10 kgf) to a final load of 1275 N (130 kgf) was measured in millimeters.

Durability Index

The durability of the molded material was evaluated using an ADC Ball COR Durability Tester produced by Automated Design Corporation (U.S.). This tester has the ability to fire a spherical molding using air pressure and cause it to repeatedly strike two metal plates arranged in parallel. The average number of firings needed until the molding cracks was treated as the durability. The incident velocity of the molding on the metal plates was 30 m/s. The values for the examples of the invention were expressed as indexes based on a value of "100" for the durability of the molding in Comparative Example 1.

Initial Velocity Index

The initial velocity was measured with an initial velocity measuring apparatus of the same type as that of the United States Golf Association (USGA)—the official golf ball regulating body. The results shown for Examples 1 to 4 of the invention and in Comparative Examples 2 to 4 are ratios of the respective initial velocities based on the initial velocity obtained in Comparative Example 1.

TABLE 2

| | Example | | | | Comparative Example | | | |
|---|---|---|---|---|---|---|---|---|
| | 1 | 2 | 3 | 4 | 1 | 2 | 3 | 4 |
| Hardness under loading (mm) | 3.8 | 3.5 | 3.5 | 3.5 | 4.3 | 4.0 | 3.7 | 3.6 |
| Durability index | 290 | 360 | 380 | 355 | 100 | 190 | 270 | 280 |
| Initial velocity index | 1.004 | 1.007 | 1.008 | 1.007 | 1.000 | 1.003 | 1.005 | 1.006 |

It is apparent from the results in Table 2 that the molded rubber materials according to the invention (Examples 1 to 4) had a relatively high hardness and an excellent durability compared with the molded rubber materials obtained in Comparative Examples 1 to 4. In particular, the molded rubber materials of the invention had a high hardness and both an excellent durability and initial velocity relative to the molded rubber materials obtained in Comparative Examples 2 to 4 using ultrafine zinc oxide having an average particle size of 0.02 μm.

Example 5 and Comparative Example 5

Rubber compositions formulated as shown in Table 3 were prepared, masticated in a kneader or on a roll mill, then hot-molded in a spherical mold under vulcanization conditions of 160° C. and 20 minutes to give spherical crosslinked rubber moldings having a diameter of 37.7 mm. The hardness (deflection) and durability of the spherical rubber moldings were evaluated according the above criteria.

The results are given in Table 4.

TABLE 3

| | Example 5 | Comparative Example 5 |
|---|---|---|
| Polybutadiene | 100 | 100 |
| Zinc acrylate | 28 | 28 |
| Zinc oxide I (arc plasma process) | 2 | 0 |
| Zinc oxide II (electric furnace process) | 0 | 2 |
| Antioxidant | 0.1 | 0.1 |
| Organosulfur compound | 1 | 1 |
| Organic peroxide (1) | 0.3 | 0.3 |
| Organic peroxide (2) | 0.3 | 0.3 |
| Amount of zinc oxide addition relative to zinc acrylate (wt %) | 7.1 | 7.1 |

Note:
Numbers in the table indicate parts by weight

TABLE 4

| | Example 5 | Comparative Example 5 |
|---|---|---|
| Hardness under loading (mm) | 3.9 | 4.1 |
| Durability index | 260 | 200 |
| Initial velocity index | 1.014 | 1.012 |

It is apparent from the results in Table 4 that the rubber molding according to the invention (Example 5) had a higher core hardness and a better core durability than the rubber molding obtained in Comparative Example 5.

Figure 2:
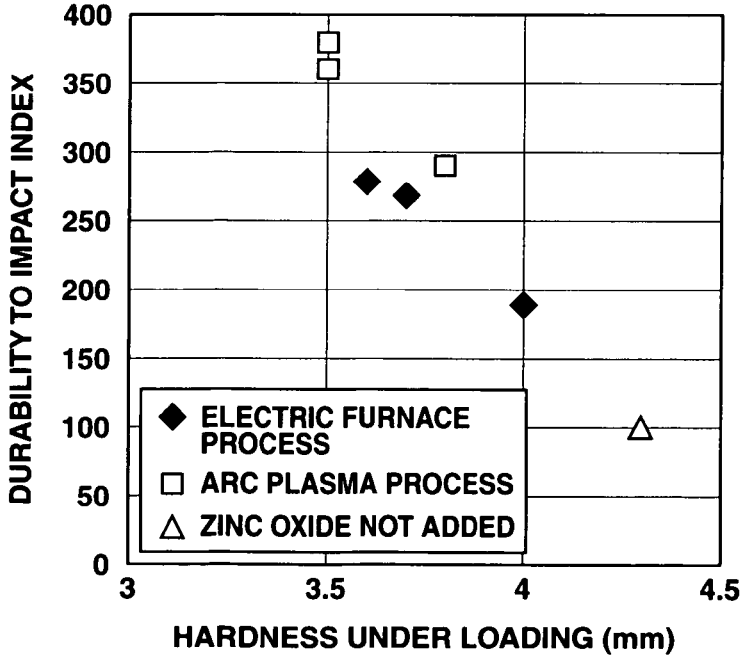
FIG. 2 is a graph showing the relationship between the hardness of the molded materials under loading and their impact durability index.
Figure 3:
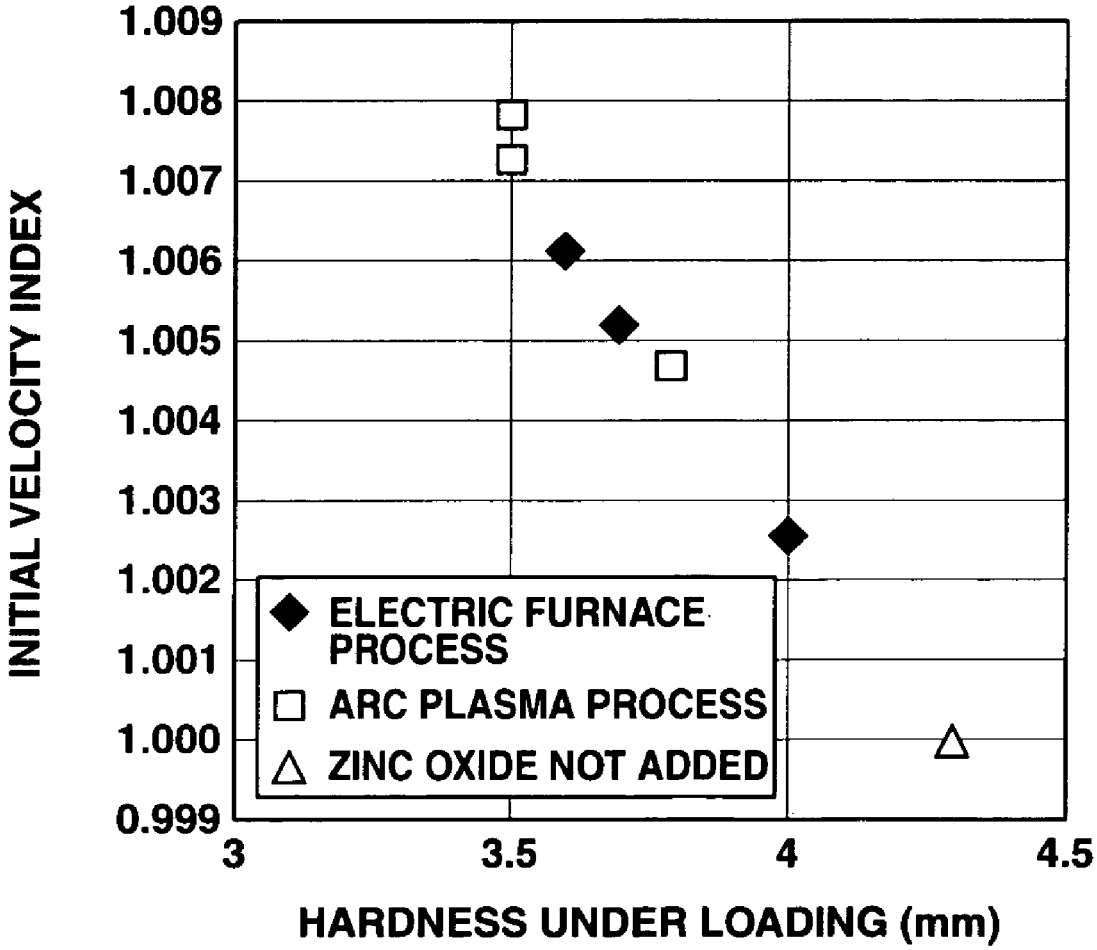
FIG. 3 is a graph showing the relationship between the hardness of the molded materials under loading and their initial velocity index.

Based on the above experimental results, the graphs in FIGS. 1 to 3 compare the hardness under loading, durability index and initial velocity index of molded materials produced using zinc oxide obtained by the arc plasma process (present invention) with those of molded materials produced using zinc oxide obtained by the electric furnace process (prior-art examples).

The invention claimed is:

1. A molded rubber material for a golf ball which is obtained by molding and vulcanizing a rubber composition comprising (a) a diene rubber, (b) an α,β-unsaturated carboxylic acid and/or a metal salt thereof, (c) an organic peroxide, and (d) an inorganic oxide; wherein the inorganic oxide is prepared by a plasma process, a laser process or flame synthesis, has an average particle size of at most 200 nm, and is added in an amount of at least 1 wt % based on the α,β-unsaturated carboxylic acid and/or metal salt thereof.

2. The molded rubber material for a golf ball of claim 1, wherein the inorganic oxide is prepared by a plasma process, which plasma process is selected from the group consisting of arc plasma processes, plasma jet processes, and high-frequency induction heating plasma processes.

3. The molded rubber material for a golf ball of claim 2, wherein the plasma process is an arc plasma process.

4. The molded rubber material for a golf bail of claim 1, wherein the inorganic oxide is zinc oxide.

5. The molded rubber material for a golf ball of claim 1, wherein the rubber composition additionally includes an organosulfur compound.

6. The molded rubber material for a golf ball of claim 1, wherein the rubber composition additionally includes an inorganic oxide having an average particle size of at least 200 nm.

7. A golf ball comprising a solid core and a cover of one or more layers which encloses the core, wherein the molded rubber material according to any one of claims 1 to 6 is used as the solid core.

8. A method of manufacturing a molded rubber material for a golf ball, the method being comprised of molding and vulcanizing a rubber composition composed of (a) a diene rubber, (b) an α,β-unsaturated carboxylic acid and/or a metal salt thereof, (c) an organic peroxide, and (d) an inorganic oxide; wherein the inorganic oxide is prepared by a plasma process, a laser process or flame synthesis, has an average particle size of at most 200 nm, and is added in an amount of at least 1 wt % based on the α,β-unsaturated carboxylic acid to and/or metal salt thereof.

9. The molded rubber material for a golf ball of claim 1, wherein the diene rubber is a polybutadiene synthesized using a rare earth catalyst.

10. The molded rubber material for a golf ball of claim 1, further comprising from 0.05 to 3 parts by weight of an antioxidant per 100 parts by weight of the diene rubber serving as component (a).

11. The molded rubber material for a golf ball of claim 1, wherein the added amount of the inorganic oxide is from 1 to 30 wt %, based on the α,β-unsaturated carboxylic acid and/or metal salt thereof serving as component (b).

12. The molded rubber material for a golf ball of claim 1, wherein the added amount of the inorganic oxide is from 1 to 20 wt %, based on the α,β-unsaturated carboxylic acid and/or metal salt thereof serving as component (b).

13. The molded rubber material for a golf ball of claim 1, wherein the inorganic oxide is an ultrafine zinc oxide having an average primary particle size of 0.03 μm obtained by the arc plasma process.

* * * * *